United States Patent [19]

Miyasaka et al.

[11] Patent Number: 4,624,913

[45] Date of Patent: Nov. 25, 1986

[54] SILVER HALIDE PHOTOGRAPHIC LIGHT-SENSITIVE MATERIALS

[75] Inventors: Nobuaki Miyasaka; Koki Nakamura; Shigeki Yokoyama, all of Kanagawa, Japan

[73] Assignee: Fuji Photo Film Co., Ltd., Kanagawa, Japan

[21] Appl. No.: 700,251

[22] Filed: Feb. 11, 1985

[30] Foreign Application Priority Data

Feb. 9, 1984 [JP] Japan ..... 58-22621

[51] Int. Cl.[4] ..... G03C 1/38; G03C 5/24; G03C 1/34

[52] U.S. Cl. ..... 430/444; 430/445; 430/446; 430/448; 430/966; 430/949; 430/602; 430/609; 430/567; 430/611; 430/614

[58] Field of Search ..... 430/637, 966, 449, 602, 430/609, 611, 614, 567, 444, 445, 446, 448

[56] References Cited

U.S. PATENT DOCUMENTS

| | | | |
|---|---|---|---|
| 2,996,382 | 8/1961 | Luckey et al. | 430/202 |
| 3,532,501 | 10/1970 | Mackey et al. | 430/602 |
| 3,551,152 | 12/1970 | Scudder et al. | 430/351 |
| 3,552,972 | 1/1971 | Meyer et al. | 430/637 |
| 3,725,080 | 4/1973 | Mackey | 430/637 |
| 3,915,710 | 10/1975 | Habu et al. | 430/608 |
| 4,272,616 | 6/1981 | Kishimoto | 430/637 |
| 4,351,896 | 9/1982 | Altland et al. | 430/354 |
| 4,378,424 | 3/1983 | Altland et al. | 430/352 |
| 4,459,351 | 7/1984 | Adin et al. | 430/506 |
| 4,500,631 | 2/1985 | Sakamoto et al. | 430/966 |

OTHER PUBLICATIONS

Research Disclosure 18431 Aug. 1979.

*Primary Examiner*—Won H. Louie

*Attorney, Agent, or Firm*—Sughrue, Mion, Zinn, Macpeak and Seas

[57] ABSTRACT

A silver halide photographic light-sensitive material is described, comprising at least one light-sensitive silver halide emulsion layer on a support, wherein the emulsion in said light-sensitive silver halide emulsion layer comprises a silver iodobromide emulsion containing 3 mol % or more of iodide, and at least one of said light-sensitive emulsion layer or another hydrophilic colloid layer contains a polyoxyethylene type surface active agent and at least one of said light-sensitive emulsion layer or another hydrophilic colloid layer contains a meso-ionic triazolium compound represented by formula (I)

(I)

wherein X represents a sulfur ion or —N—$R^4$, and $R^1$, $R^2$, $R^3$, and $R^4$ each represents a hydrogen atom or a substituted or nonsubstituted alkyl group, aryl group, or heterocyclic group, or $R^1$ and $R^2$, $R^2$ and $R^3$ or $R^3$ and $R^4$ can together form a heterocyclic ring.

30 Claims, No Drawings

SILVER HALIDE PHOTOGRAPHIC LIGHT-SENSITIVE MATERIALS

FIELD OF THE INVENTION

The present invention relates to silver halide photographic light-sensitive materials, and particularly to silver halide photographic light-sensitive materials having a high silver iodide content.

BACKGROUND OF THE INVENTION

Generally, in silver halide photographic light-sensitive materials, it is desirable to increase iodide content for the purpose of high sensitization, etc.

For example, in conventional medical X-ray films, silver iodobromide emulsions containing, generally, about 2 mol % iodide are frequently used without carrying out spectral sensitization. However, if the iodide content of the emulsion can be increased, higher sensitization should be able to be achieved, because the absorptivity of blue light increases, and higher sensitization has actually been achieved in this manner. Higher sensitization can be utilized for increasing optical density (the so-called covering power) of developed silver by making fine grains. Further, in a film wherein light-sensitive emulsions are applied to both sides of a base, the undesirable so-called cross-over light effect (whereby not only the emulsion face in contact with each layer of fluorescent substance but also the other emulsion face on the reverse side of the base is exposed to blue light emitted from the fluorescent intensifying screen by X-rays) can be reduced by increasing the iodide content of the emulsion, with higher sharpness thereby being attained. In addition, it is very desirable to increase the iodide content in order to provide a sufficient effect of the type described in Japanese Patent Publication 2068/66, U.S. Pat. Nos. 2,996,382 and 3,178,282, Japanese Patent Publications 27065/69 and 8738/72 and U.S. Pat. No. 1,426,277, namely, the effect of increasing the covering power of developed silver by developing fine internally fogged grains with iodine released from light-sensitive grains during development.

Although increasing the iodide content has numberous advantages, there are also some serious problems absociated therewith. For example, the high iodide content emulsions have a serious problem in that the photographic properties (e.g., sensitivity, gradation, and fog) are greatly influenced by factors such as the processing temperature and the amount of halogen in the processing solution when they are processed with a high temperature rapid developing solution containing a glutaraldehyde type hardener. In order to reduce the processing condition reliance (temperature, amount of halogen, and the like) of photographic properties in the high temperature developing solution, certain techniques have been known. For example, such techniques include an effect of preventing yellow fog by addition of nitron salts (e.g., 1,4-diphenyl-3,5-eudsanilin-4,5-dihydro-1,2,4-triazole, 3,5,6-triphenyl-2,3,5,6-triphenyl-2,3,5,6-tetrazabicycles (2,1,1) hex-le as described in Japanese Patent Publication 28691/77, and Research Disclosure (RD)-18431, page 434; and effect of improving processing temperature reliance by addition of meso-ionic triazolium compounds other than nitron, as described in Japanese Patent Application Nos. 196560/83 (corresponding to U.S. patent application Ser. No. 662,112 filed on Oct. 12, 1984), 224762/83 and 231088/83 (corresponding to U.S. patent application Ser. No. 678,906 filed on Dec. 6, 1984), an effect of preventing fog by means of mercapto compounds and benzotriazole compounds described in U.S. Pat. Nos. 3,954,474 and 3,982,947 and Japanese Patent Publication No. 28660/77, an effect of improving processing temperature reliance by addition of nonionic surface active agents having one polyoxyethylene chain in the molecule described in British Pat. No. 861,134 and West German Pat. No. 1,422,809; an effect of preventing fog in color developing solutions by means of blue-light spectrally sensitizing dyes as described in U.S. Pat. No. 2,131,038, Japanese Patent Application (OPI) No. 61519/79 (the term "OPI" as used herein means a "published unexamined Japanese Patent Application"), U.S. Pat. No. 3,930,860 and Japanese Patent Application (OPI) No. 119917/75; and improvement (viz., a decrease) in processing temperature reliance by means of selective blue-light spectrally sensitizing dyes, though such technique is restricted to tabular grains, as described in Japanese Patent Application Nos. 166321/82 (corresponding to U.S. patent application Ser. No. 536,044 filed on Sept. 25, 1984) and 40249/83 (corresponding to U.S. patent application Ser. No. 588,410 filed on Mar. 12, 1984). However, these techniques have problems of desensitization, fog, etc.

For example, meso-ionic triazolium compounds show a great desensitization effect, though having an effect of improving processing reliance and a desensitization effect (particularly, the desensitizaction effect in a developing solution containing no glutaraldehyde is very great). Mercapto compounds show a very great desensitization effect as compared with their beneficial effect of improving processing reliance. Light-sensitive materials containing polyoxyethylene compounds as described in Japanese Patent Application (OPI) No. 185304/83 have probelms in that they easily form pressure mark caused by rollers used in the automatic developing apparatus, and the granularity easily deteriorates in a developing solution containing no glutaraldehyde.

SUMMARY OF THE INVENTION

Accordingly, an object of the present invention is to provide silver halide photographic light-sensitive materials comprising a high-iodide silver iodobromide emulsion (i.e., a silver iodobromide emulsion having a high iodide content) having an iodide content of 3 mol % or more, which have less development processing reliance than the above-described materials.

Another object of the present invention is to provide silver halide photographic light-sensitive materials comprising a high-iodide silver iodobromide emulsion, in which sensitivity is not reduced and deterioration of granularity is less compared to the above-described materials.

A further object of the present invention is to provide silver halide photographic light-sensitive materials comprising a high-iodide silver iodobromide emulsion, which are less subject to formation of pressure marks by rollers.

The above described objects of the present invention can be attained by providing silver halide photographic light-sensitive materials comprising at least one light-sensitive silver halide emulsion layer on a support (also referred to as a base), wherein the emulsion in said light-sensitive silver halide emulsion layer comprises a silver iodobromide emulsion containing 3 mol % or more of iodide, and at least one of said light-sensitive emulsion layer or another hydrophilic colloid layer (for example, a silver halide emulsion layer, an inter layer or a protective layer, etc.) contains a polyoxyethylene type surface active agent and at least one of said light-sensitive emulsion layer or another hydrophilic colloid layer ontains a meso-ionic triazolium compound represented by formula (I)

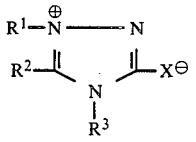

(I)

Wherein X represents a sulfur atom or —N—$R^4$, and $R^1$, $R^2$, $R^3$, or $R^4$ each represents a hydrogen atom or a substituted or nonsubstituted alkyl group, aryl group, or heterocyclic group, or $R^1$ and $R^2$, $R^2$ and $R^3$ or $R^3$ and $R^4$ can together form a heterocyclic ring by bonding.

DETAILED DESCRIPTION OF THE INVENTION

In formula (I), the substituted or nonsubstituted alkyl group has 1 to 30 carbon atoms, preferably 1 to 15 carbon atoms and includes a substituted or nonsubstituted straight-chain alkyl group (a methyl group, an ethyl group or a n-octyl group, etc.), a substituted or nonsubstituted branched-chain alkyl group (an isopropyl group, an isobutyl group, a 2-ethylhexyl group or a t-butyl group, etc.) or a substituted or nonsubstituted cycloalkyl group (a cyclopropyl group, a cyclopentyl group or a cyclohexyl group, etc.); the substituted or nonsubstituted aryl group has 6 to 30 carbon atoms, preferably 6 to 15 carbon atoms and includes a substituted or nonsubstituted phenyl group, naphthyl group, etc.; and the substituted or nonsubstituted heterocyclic group has 5 to 30 carbon atoms, preferably 5 to 15 carbon atoms and includes a substituted or nonsubstituted 3-pyridyl group, 2-furyl group, 2-benzothiazolyl group, etc.

Substituents for $R^1$, $R^2$, $R^3$, and $R^4$ include a halogen atoms, a nitro group, a cyano group, an alkoxy group, a carbamoyl group, a sulfamoyl group, a carboxyl group, an alkoxycarbonyl group, a sulfo group, an amide group, a sulfonamide group, a hydroxyl group, a sulfonyl group, a sulfinyl group, a sulfenyl group, a mercapto group, an amino group, a ureido group, an aminocarbonyloxy group, an alkoxycarbonylamino group, an aryl group and a heterocyclic group. One or more there of can be substituted.

$R^1$ and $R^2$, $R^2$ and $R^3$, or $R^3$ and $R^4$ can together form a ring (for example, a 5-member ring or a 6-member ring) by bonding, provided that $R^1$ and $R^2$, and $R^2$ and $R^3$ do not form rings at the same time. However, $R^1$ and $R^2$, and $R^3$ and $R^4$ may form rings at the same time.

In the following, examples of meso-ionic triazolium compounds useful in the present invention are shown, but the compounds capable of using in the present invention are not restricted to these examples.

I-1

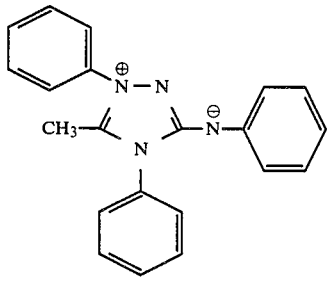

I-2

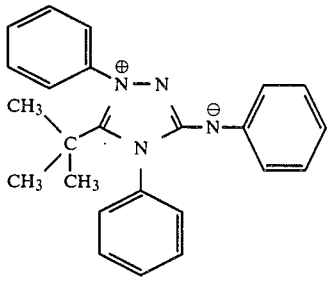

I-3

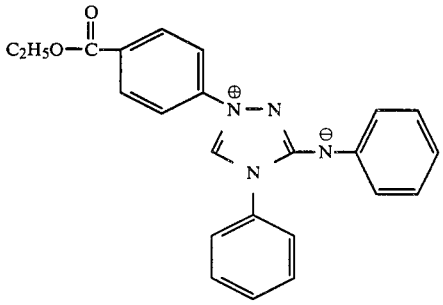

I-4

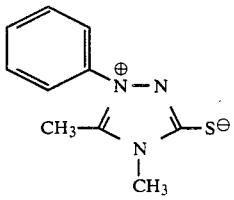

I-5

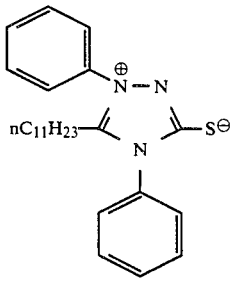

-continued

I-6

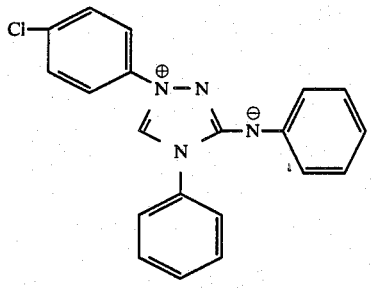

I-7

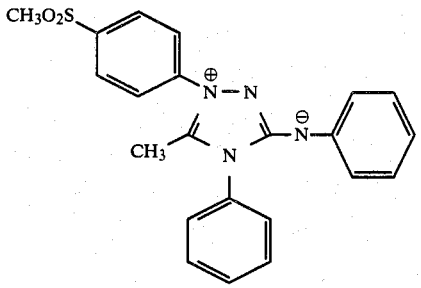

I-8

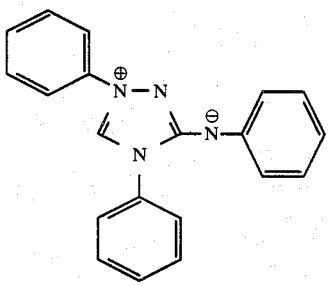

I-9

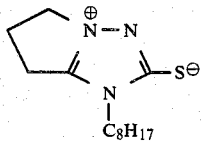

I-10

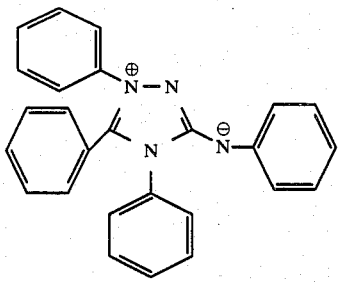

-continued

I-11

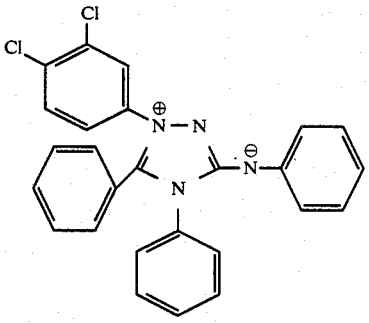

In addition, analogous compounds as described in Japanese Patent Application Nos. 196560/83, 224762/83 and 231088/83 can be used as well.

Meso-ionic triazolium compounds represented by formula (I) can be easily synthesized according to processes as described, e.g., in Japanese Patent Application Nos. 224762/83, 224762/83, and 231088/83.

As polyoxyethylene type surface active agents in the present invention, those comprising at least two oxyethylene groups, and preferably from 5 to 50 oxyethylene groups, are used.

As the polyoxyethylene type surface active agents, surface active agents represented by formulae (II-1), (II-2), and (II-3) are particularly preferable for use.

$$R_{11}-A\left(CH_2CH_2O\right)_{n_1}H \qquad \text{(II-1)}$$

(II-2)

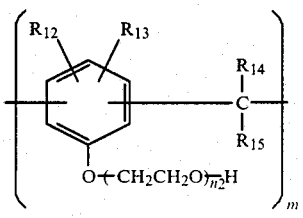

(II-3)

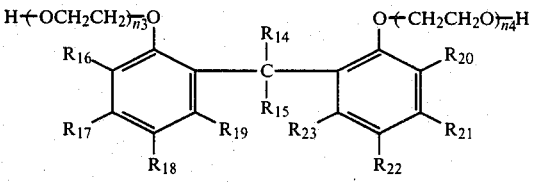

In the formulae (II -1), (II-2), and (II-3), $R_{11}$ represents a substituted or nonsubstituted slkyl, alkenyl or aryl group having 1 to 30 carbon atoms, and A represents —O—, —S—, —COO—, $$-\underset{|}{N}-R_{24},\ -CO-\underset{|}{N}-R_{24},\ \text{or}\ -SO_2\underset{|}{N}-R_{24},$$

wherein $R_{24}$ represents a hydrogen atom or a substituted or nonsubstituted alkyl group having 1 to 30 carbon atoms. $R_{12}$, $R_{13}$, $R_{17}$, $R_{19}$, $R_{21}$, and $R_{23}$ each represents a hydrogen atom, a substituted or nonsubstituted alkyl group, an aryl group, an alkoxy group, a halogen atom, an acyl group, an amide group, a sulfonamide group, a carbamoyl group, or a sulfamoyl group. $R_{16}$, $R_{18}$, $R_{20}$, and $R_{22}$ each represents a substituted or nonsubstituted alkyl group, an aryl group, an alkoxy group, a halogen atom, an acyl group, an amide group, a sulfonamide group, a carbamoyl group, or a sulfamoyl group. $R_{14}$ and $R_{15}$ each represents a hydrogen atom, or a substituted or nonsubstituted alkyl, aryl or heteroaromatic group having 1 to 15 carbon atoms. Also, $R_{14}$ and $R_{15}$, $R_{16}$ and $R_{17}$, $R_{18}$ and $R_{19}$, $R_{20}$ and $R_{21}$, and $R_{22}$ and $R_{23}$ can together form a substituted or nonsubstituted ring by bonding. $n_1$, $n_2$, $n_3$, and $n_4$ each refers to the average degree of polymerization of the ethylene oxide, each is a number of 5 to 50. m refers to the average degree of polymerization of the main chain of formula (II-2), and is a number of from 5 to 50.

In formulae (II-1), (II-2), and (II-3), $R_{11}$ preferably represents an alkyl, alkenyl or alkylaryl group having 4 to 24 carbon atoms, and, particularly preferably it represents a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group, or an octylnaphthyl group.

$R_{12}$, $R_{13}$, $R_{16}$, $R_{17}$, $R_{18}$, $R_{19}$, $R_{20}$, $R_{21}$, $R_{22}$ and $R_{23}$ preferably each represents a substituted or nonsubstituted alkyl group having from 1 to 20 carbon atoms, such as a methyl, ethyl, i-propyl, t-butyl, t-amyl, t-hexyl, t-octyl, nonyl, decyl, dodecyl, trichloromethyl, tribromomethyl, 1-phenylethyl, 2-phenyl-2-propyl group, etc., a substituted or nonsubstituted aryl group, such as a phenyl group, a p-chlorophenyl group, etc., a substituted or nonsubstituted alkoxy group represented by $-OR_{25}$, wherein $R_{25}$ represents a substituted or nonsubstituted alkyl group having from 1 to 20 carbon atoms or an aryl group (and $R_{25}$ has the same meaning hereinafter), a halogen atom such as a chlorine atom, a bromine atom, etc., an acyl group represented by $-COR_{25}$, an amide group represented by $-NR_{26}COR_{25}$, wherein $R_{26}$ represents a hydrogen atom or an alkyl group having from 1 to 20 carbon atoms (and $R_{26}$ has the same meaning hereinafter), a sulfonamide group represented by $-NR_{26}SO_2R_{25}$, a carbamoyl group represented by

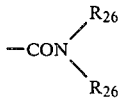

or a sulfamoyl group represented by

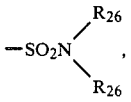

and $R_{12}$, $R_{13}$, $R_{17}$, $R_{19}$, and $R_{23}$ can each be a hydrogen atom. Of these, $R_{16}$, $R_{18}$, $R_{20}$, and $R_{22}$ more preferably each represents an alkyl group or a halogen atom, and particularly preferably they each represent a bulky tertiary alkyl group such as a t-butyl group, a t-amyl group, a t-octyl group, etc. $R_{17}$, $R_{19}$, $R_{21}$, and $R_{23}$ particularly preferably each represents a hydrogen atom. Compounds represented by formula (II-3) synthesized from 2,4-di-substituted phenols are particularly preferred.

$R_{14}$ and $R_{15}$ preferably each represents a hydrogen atom, a substituted or nonsubstituted alkyl group such as a methyl group, an ethyl group, a n-propyl group, an isopropyl group, a n-heptyl group, a 1-ethylamyl group, a n-undecyl group, a tricholoromethyl group, a tribromomethyl group, etc., or a substituted or nonsubstituted aryl group such as an α-furyl group, a phenyl group, a naphthyl group, a p-chlorophenyl group, a p-methoxyphenyl group, a m-nitrophenyl group, etc. $R_{14}$ and $R_{15}$, $R_{16}$ and $R_{17}$, $R_{18}$ and $R_{19}$, $R_{20}$ and $R_{21}$, and $R_{22}$ and $R_{23}$ can together form a substituted or nonsubstituted ring, for example, a cyclohexyl ring (by bonding each other). $R_{14}$ and $R_{15}$ particularly preferably each represents a hydrogen atom, an alkyl group having from 1 to 8 carbon atoms, a phenyl group, or a furyl group. $n_1$, $n_2$, $n_3$, and $n_4$ particularly preferably each is a number of from 5 to 30. $n_3$ and $n_4$ may be identical or different.

Compounds of formulae (II-2) and (II-3) are preferably used, and particularly preferably a compound of formula (II-3) is used.

In the following, examples of polyoxyethylene type surface active agents used according to the present invention are illustrated.

$C_{11}H_{23}COO(CH_2CH_2O)_8H$ II-(1)
$C_{15}H_{31}COO(CH_2CH_2O)_{15}H$ II-(2)
$C_{17}H_{33}COO(CH_2CH_2O)_{15}H$ II-(3)
$C_{17}H_{33}COO(CH_2CH_2O)_{25}H$ II-(4)
$C_{17}H_{33}COO(CH_2CH_2O)_{50}H$ II-(5)
$C_8H_{17}O(CH_2CH_2O)_7H$ II-(6)
$C_{12}H_{25}O(CH_2CH_2O)_{10}H$ II-(7)
$C_{12}H_{25}O(CH_2CH_2O)_{25}H$ II-(8)
$C_{12}H_{25}O(CH_2CH_2O)_{50}H$ II-(9)
$C_{16}H_{33}O(CH_2CH_2O)_{12}H$ II-(10)
$C_{17}H_{35}O(CH_2CH_2O)_{25}H$ II-(11)
$C_{17}H_{35}O(CH_2CH_2O)_{50}H$ II-(12)
$C_{17}H_{35}COO(CH_2CH_2O)_{50}H$ II-(13)

II-(14)

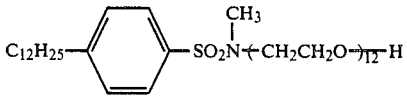

$C_{22}H_{45}O(CH_2CH_2O)_{25}H$ II-(15)

II-(16)

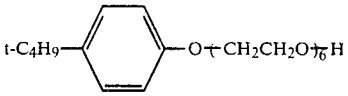

II-(17)

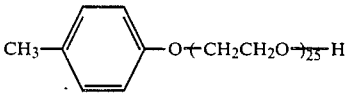

II-(18)

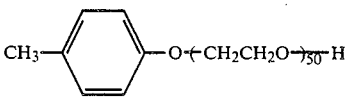

II-(19)

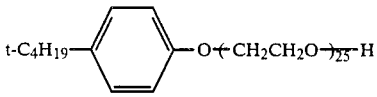

II-(20)

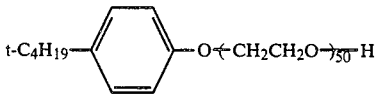

II-(21)

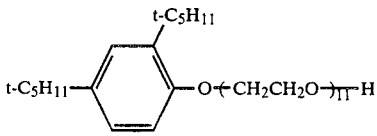

-continued
II-(22)
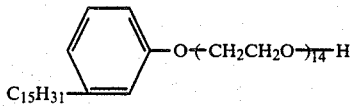
II-(23)
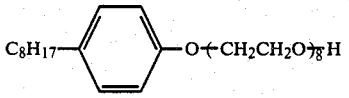
II-(24)
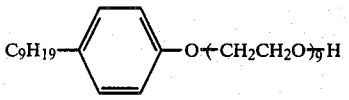
II-(25)
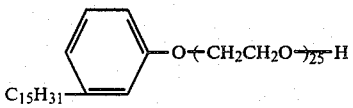
II-(26)
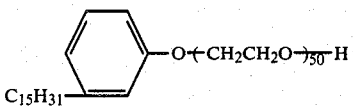
II-(27)
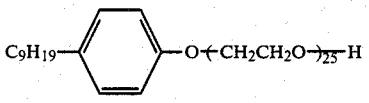
II-(28)
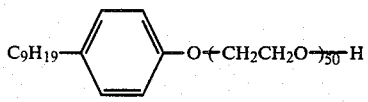
II-(29)
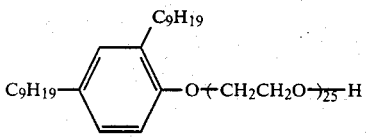
II-(30)
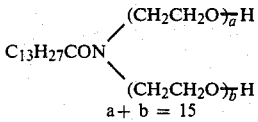
a+ b = 15
II-(31)
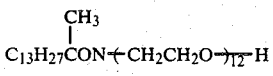
II-(32)
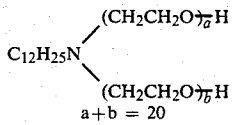
a+b = 20
II-(33)
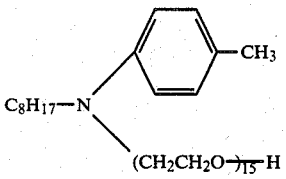
II-(34)
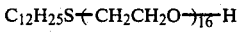
II-(35)
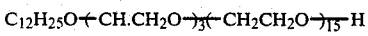
-continued
II-(36)
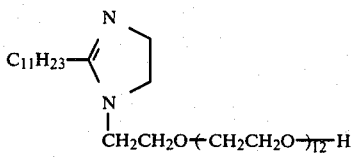
II-(37)
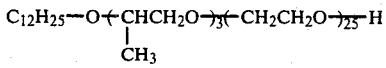
II-(38)
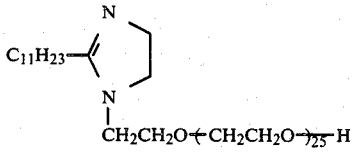
II-(39)
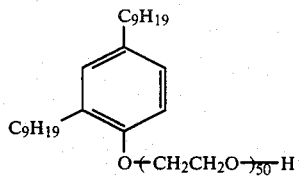
II-(40)
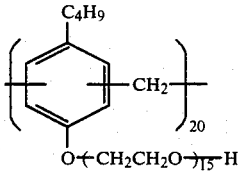
II-(41)
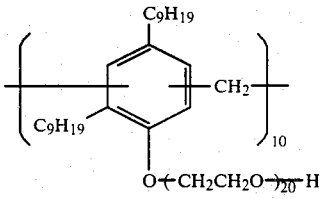
II-(42)
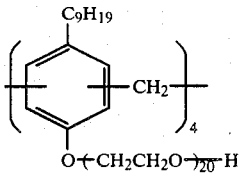
II-(43)
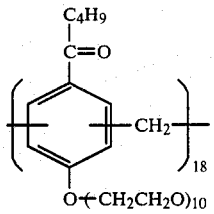
II-(44)
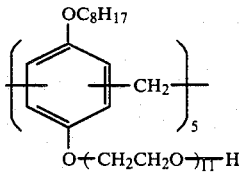

-continued
II-(45)
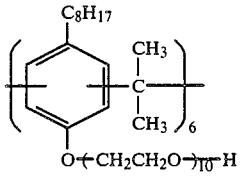
II-(46)
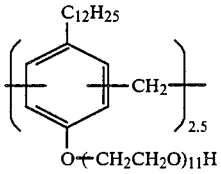
II-(47)
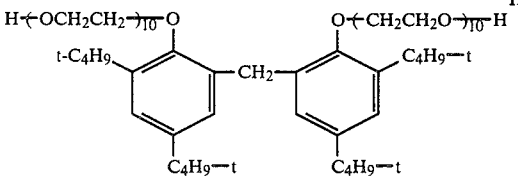
II-(48)
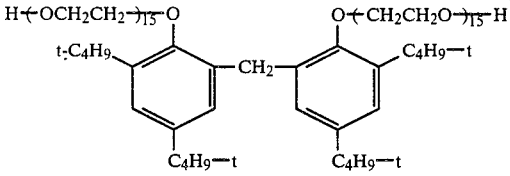
(II-(49)
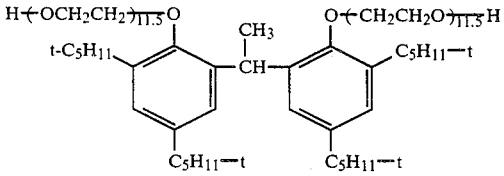
II-(50)
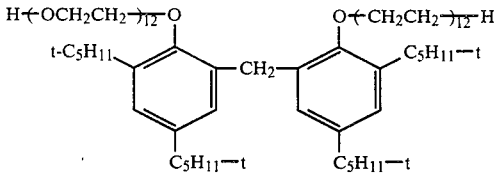
II-(51)
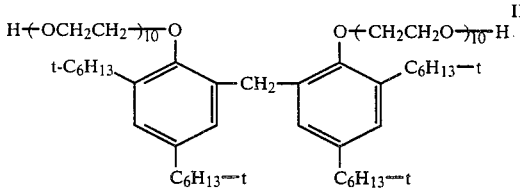
II-(52)
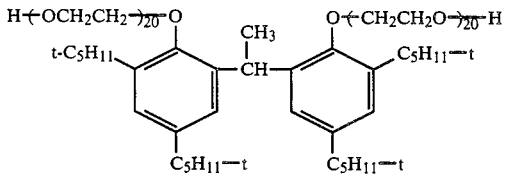
-continued
II-(53)
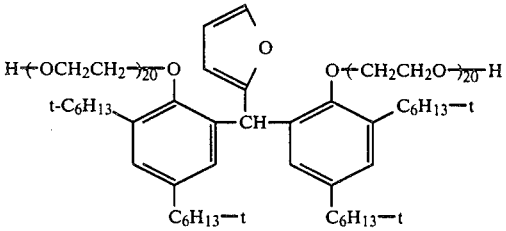
II-(54)
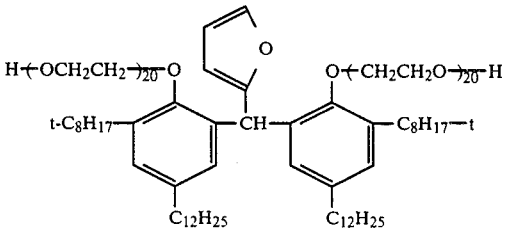
II-(55)
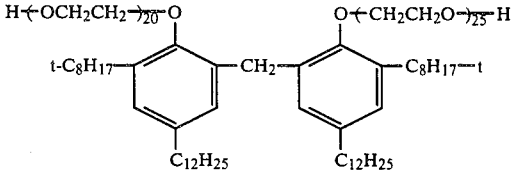
II-(56)
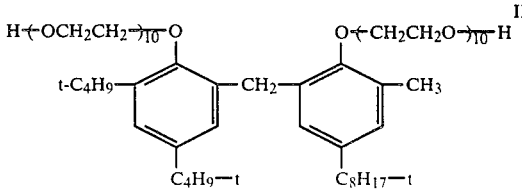
II-(57)
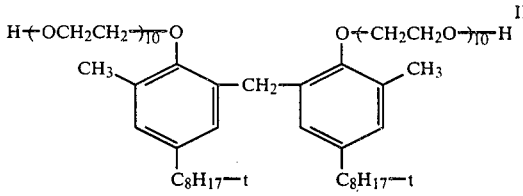
II-(58)
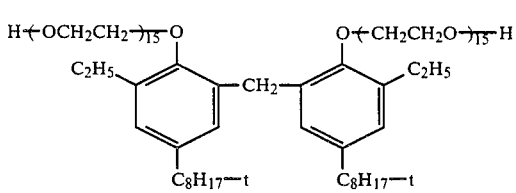
II-(59)
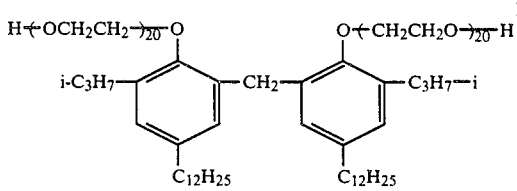

-continued
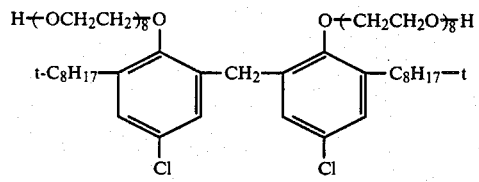
II-(60)
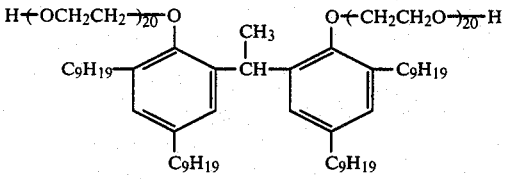
II-(61)
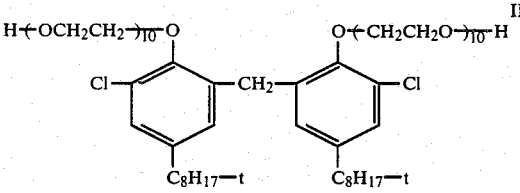
II-(62)
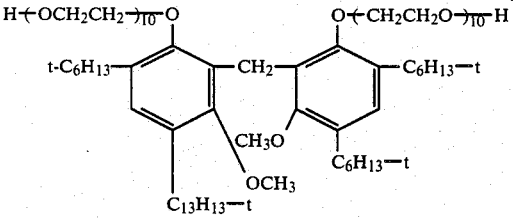
II-(63)
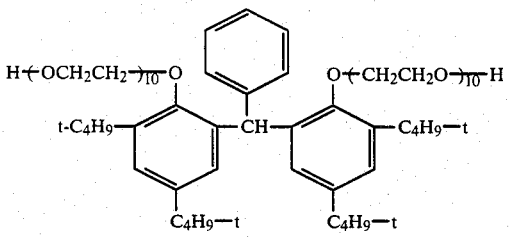
II-(64)
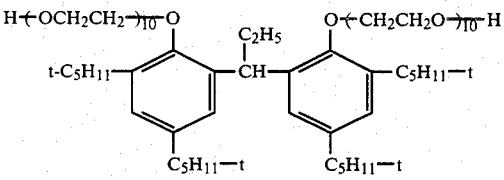
II-(65)
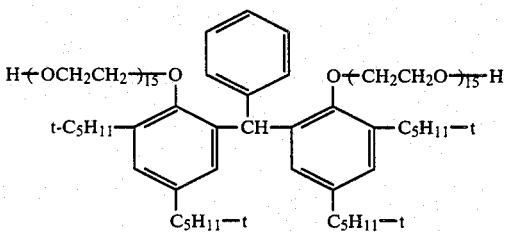
II-(66)
-continued
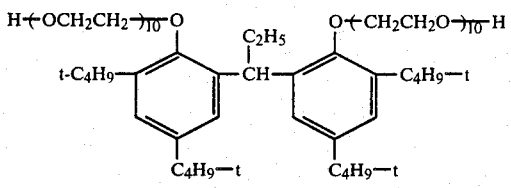
II-(67)
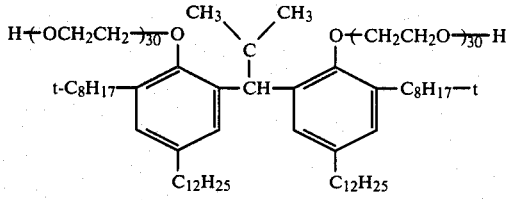
II-(68)
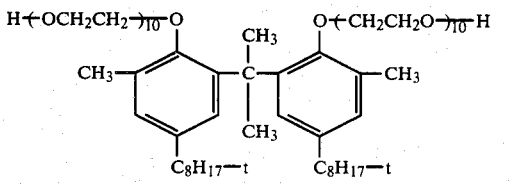
II-(69)
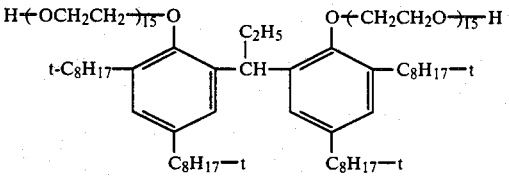
II-(70)
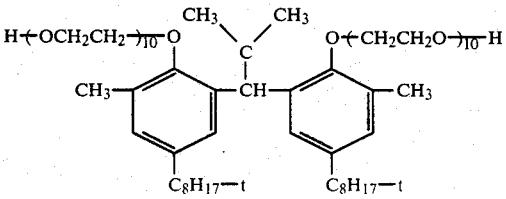
II-(71)
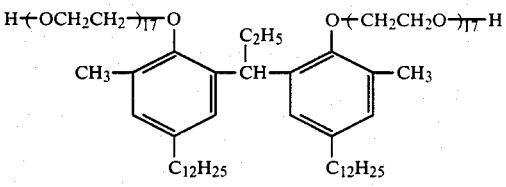
II-(72)
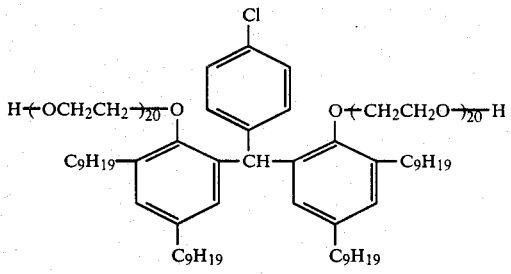
II-(73)
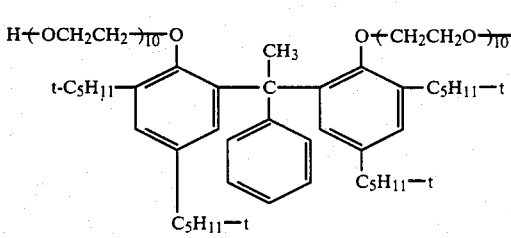
II-(74)

-continued
II-(75)
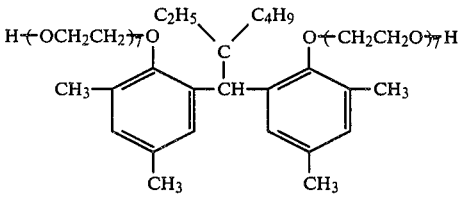
II-(76)
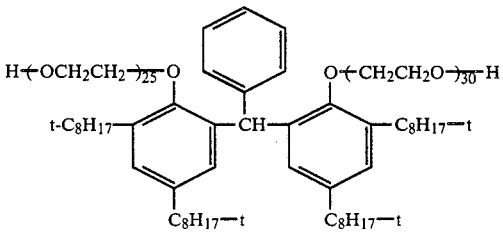
II-(77)
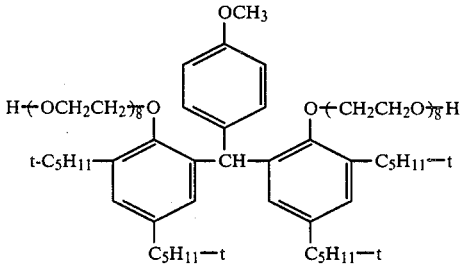
II-(78)
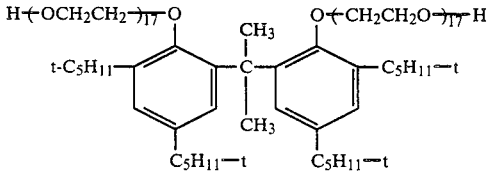
II-(79)
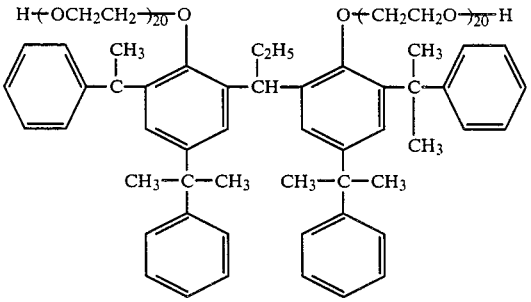
II-(80)
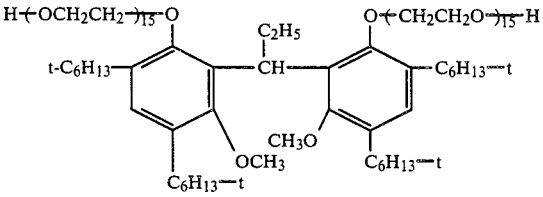
-continued
II-(81)
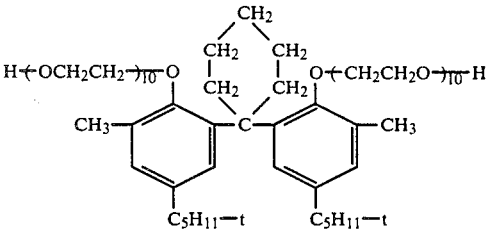
II-(82)
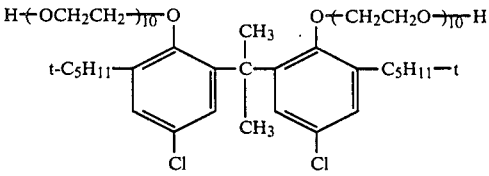
II-(83)
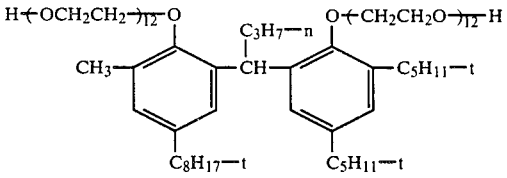
II-(84)
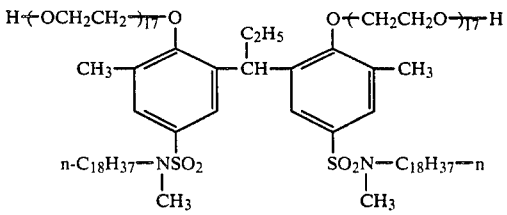
II-(85)
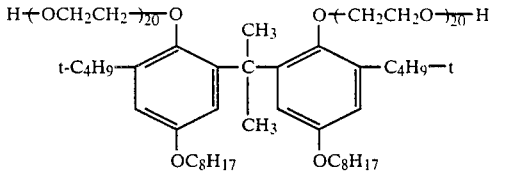
II-(86)
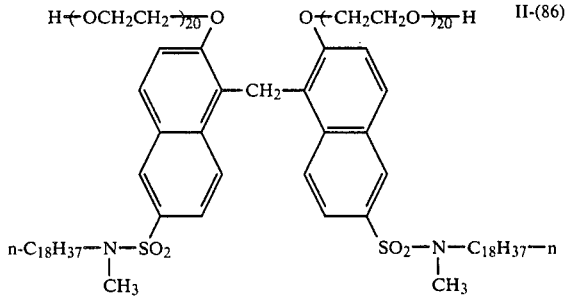
II-(87)
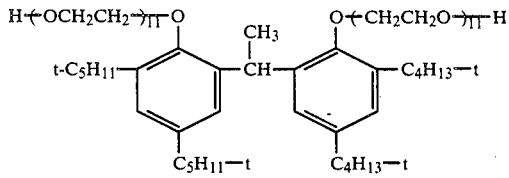

-continued

II-(88)

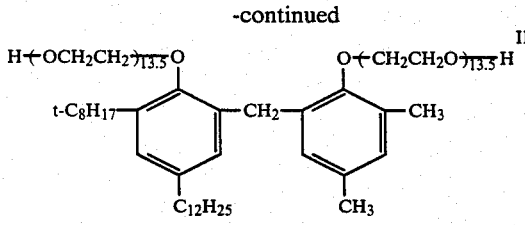

II-(89)

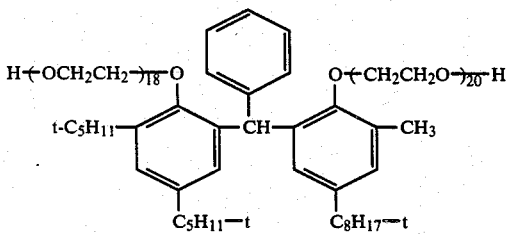

II-(90)

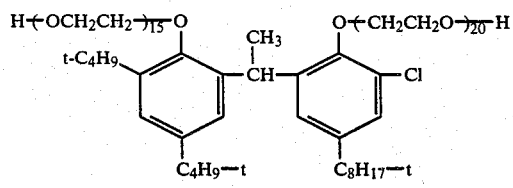

Polyoxyethylene type surface active agents as described in the following patents can be used in addition to the above described examples.

For example, U.S. Pat. Nos. 2,982,651, 3,428,456, 3,454,625, 3,457,076, 3,552,972 and 3,655,387, Japanese Patent Publication No. 9610/76, Japanese Patent Application (OPI) Nos. 29715/78 and 89626/79, Japanese Patent Application Nos. 85764/82 (corresponding to U.S. patent application Ser. Nos. 497,285 filed on May 23, 1983) and 90909/82 (corresponding to U.S. patent application Ser. No. 499,066 filed on May 27, 1983), Hiroshi Horiguchi: "Shinkaimen-kasseizai" (Sankyo Shuppan, 1975), etc., describe useful polyoxyethylene type surface active agents.

The compound represented by formula (I) according to the present invention is preferably added to a light-sensitive emulsion layer of the photographic light-sensitive material, but it may be added to another, non-sensitive, layer. In order to add the compound to the layer, the compound is added to a coating solution as is, or after dissolving it in water, the above described organic solvent or a mixture of water and the above described organic solvent, or it is added as an acid solution of the compound represented by formula (I), and the coating solution may be then applied and dried.

In the case of adding it to the emulsion layer, it may be added to the emulsion during process of producing the emulsion (chemical ripening process, etc.) or after conclusion of the process. It is particularly preferred to add it just before coating after production of the emulsion.

The amount of the compound represented by formula (I) depends upon the kind of light-sensitive silver halide emulsion in the photographic light-sensitive material, but it is generally preferred to be in a range of from $5\times10^{-6}$ to $5\times10^{-2}$ mols per mol of silver, and particularly preferably it is present in a range of from $5\times10^{-5}$ to $5\times10^{-3}$ mols per mol of silver.

The amount of the polyoxyethylene type surface active agent used in the present invention can be selected depending upon the particular kind and form of the photographic light-sensitive material, coating method, etc., but it is generally in a range of from 0.05 to 500 mg (one side), and preferably from 0.5 to 100 mg (one side), per $m^2$ of the photographic light-sensitive material.

In order to add the polyoxyethylene type surface active agent of the present invention to layers of the photographic light-sensitive material, it is dissolved in water or an organic solvent such as methanol, ethanol, acetone, etc., or a mixture of water and such organic solvent, and thereafter it is incorporated in a light-sensitive emulsion layer or another non-sensitive layer (for example, a backing layer, an antihalation layer, an inter layer, a protective layer, etc.) on the support or it is sprayed on or coated to the surface of the support or the support is dipped in the solution and dried.

The polyoxyethylene type surface active agent and the compound represented by formula (I) of the present invention may be contained in the same layer of the photographic light-sensitive material or may be contained in different layers. Further, such surface active agents and compounds may be contained in a plurality of layers according to the present invention.

The high-iodide silver iodobromide emulsion used in the photographic light-sensitive materials of the present invention has an iodide content of 3 mol % or more, and preferably from 3 to 10 mol %.

Silver halide grains in the photographic emulsions used in the photographic light-sensitive materials of the present invention may have a regular crystal form such as a cubic or octahedral form, an irregular crystal form such as spherical or tubular form, or a mixed crystal form thereof. They may comprise a mixture of grains having different crystal forms.

These phtographic emulsions can be prepared by processes as described in P. Glafkides, *Chimie et Physique Photographique* (Paul Montel, 1967); G. F. Duffin, *Photographic Emulsion Chemistry* (The Focal Press, 1966); V. L. Zelikman et al, *Making and Coating Photographic Emulsion* (The Focal Press, 1964); etc. Namely, any of the acid process, the neutral process, and the ammonia process can be used. As a type of reacting soluble silver salts with soluble halogen salts, any of the single-jet method, the double-jet method, and a combination there of may be used.

In the step of forming silver halide grains of physical ripening, cadmium salts, zinc salts, lead salts, thallium salts, iridium salts or complex salts thereof, rhodium salts or complex salts thereof, iron salts or complex salts thereof, etc., may be present in combination therewith.

As binders for photographic layers, it is possible to use proteins such as gelatin, casein, etc.; cellulose compounds such as carboxymethyl cellulose, hydroxyethyl cellulose, etc.; sugar derivatives such as agar, sodium alginate, starch derivatives, etc.; and synthetic hydrophilic colloids, for example, polyvinyl alcohol, poly-N-vinylpyrrolidone, polyacrylic acid copolymer, polyacrylamide or derivatives thereof and partially hydrolyzed products thereof, etc.

The term "gelatin" as used herein refers to lime processed gelatin, acid-processed gelatin and enzyme processed gelatin.

The photographic light-sensitive materials of the present invention can contain alkyl acrylate latexes as described in U.S. Pat. Nos. 3,411,911 and 3,411,912 and Japanese Patent Publication 5331/70 in the photographic constituent layers.

Silver halide emulsions can be used without carrying out chemical sensitization, i.e., as so-called primitive emulsions, but they are generally chemically sensitized. In order to carry out chemical sensitization, it is possible to use method as described in the above-moted texts of Glafkides or Zelikman et al., and in *Die Grundlagen der Photographischen Prozesse mit Silberhalogeniden,* edited by H. Frieser (Alkademische Verlagsgesellschaft, 1968).

Namely, a sulfur sensitization using a compound or activated gelatin containing sulfur capable of reacting with silver ion, a reduction sensitization using a reducing substance and a noble metal sensitization using a compound of gold or other noble metals can be used alone or in combination with each other. As sulfur sensitizers, thiosulfates, thioureas, thiazoles, rhodanines and other compounds can be used. Examples of the compounds are described in U.S. Pat. Nos. 1,574,944, 2,278,947, 2,410,689, 2,728,668 and 3,656,955. As the reduction sensitizers, stannous salts, amines, hydrazine derivatives, formamidine-sulfinic acids, silane compounds, etc., can be used. Examples of the compounds are described in U.S. Pat. Nos. 2,487,850, 2,419,974, 2,518,698, 2,983,609, 2,983,610 and 2,694,637. For noble metal sensitization, complex salts of the group VIII metals, such as platinum, iridium, palladium, etc., as well as gold complexes, can be used. Examples there of are described in U.S. Pat. Nos. 2,399,083 and 2,448,060, British Patent 618,061, etc.

In the photographic light-sensitive materials of the present invention, high sensitization, high contrast, enhancement of covering power, etc., can be achieved by using a silver halide emulsion in which the inside is fogged, together with a high-iodide light-sensitive silver iodobromide emulsion.

In this case, it is preferred that the sensitivity of silver halide emulsion in which the inside is fogged is lower than that of the light-sensitive silver halide emulsion. More specifically, it is preferred that the sensitivity of silver halide emulsion in which the inside is fogged is 1/10 or less, preferably 1/100 or less the sensitivity of the high-iodide light-sensitive silver iodobromide emulsion.

Silver halide emulsions having internal fogged nuclei that are useful in the light-sensitive materials of the present invention include for example, emulsions which give a transmission fog density (excluding the density of the support itself) of 0.5 or less when a test sample prepared by coating to a transparent support so as to have a silver content of 2 g/m$^2$ calculated as silver is developed with D-19 (developer product of Eastman Kodak Co.) at 35° C. for 2 minutes without exposure to light, and which give a transmission fog density (excluding the density of the support itself) of 1.0 or more when the same test sample is developed with a developer prepared by adding 0.5 g/l of potassium iodide to D-19 at 35° C. for 2 minutes without exposure to light.

Silver halide emulsions having internal fogged nuclei can be prepared by various known processes. As a manner of fogging, there is a method of irradiating with light or X-rays, a method which comprises producing chemically fogged nuclei with a reducing agent, a gold compound, a sulfur containing compound, etc., or a method which comprises producing an emulsion under a condition of low pAg and high pH. In order to form fogged nuclei only in the inside, there is a method which comprises bleaching fogged nuclei on the surface by a solution of red prussiate (potassium ferricyanide) after the inside and the surface of silver halide grains have been fogged by the above described method, but it is preferable to use a method which comprises preparing a core emulsion having fogged nuclei by the method of using low pAg and high pH or the method of chemically fogging, and thereafter covering the core emulsion with a shell emulsion. Processes for preparing such core-shell emulsions are known as described, for example, in U.S. Pat. No. 3,206,313.

The silver halide emulsions having internal fogged nuclei have a smaller average particle size than the high-iodide light sensitive silver iodobromide emulsion, and they are preferred to have an average particle size of from 1.0 to 0.05 μm, and preferably from 0.6 to 0.1 μm, and particularly preferably 0.5 μm or less, which give good results. As used herein, the reference to particle size, in the case of spherical particles or a form similar to spherical, refers to the mean value of the diameter; for particles of other shapes, such as cubic, the particle size is expressed as the mean calculated diameter value based on the projected areas of the particles.

In the silver halide emulsions in which the inside is fogged, any of silver bromide, silver iodobromide, silver iodochlorobromide, silver chlorobromide and silver chloride may be used.

In the silver halide photographic light-sensitive materials of the present invention, the weight ratio of the light-sensitive silver halide to the silver halide in which the inside is fogged can be varied according to type of emulsions used (for example, halogen composition), kind or use of the light-sensitive materials used, contrast of the emulsions used, etc., but it is preferred to be in a range of from 100/1 to 1/100, and preferably from 10/1 to 1/10. The total amount of silver helide coated is preferably from 0.5 to 10 g/m$^2$, more preferably from 1 to 6 g/m$^2$ (calculated as silver).

In the light-sensitive materials of the present invention, various compounds can be incorporated as stabilizers. Namely, it is possible to add many compound known as stabilizers, such as azoles, for example, benzothiazolium salts, nitroindazoles, triazoles, benzotriazoles and benzimidazoles (particularly, nitro or halogen substituted derivatives); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyridines; the above described heterocyclic mercapto compounds which have water soluble groups such as a carboxyl group, a sulfon group, etc.; thioketo compounds, for example, in oxazolinethione; azaindenes, for example, tetrazaindenes (particularly, 4-hydroxy substituted (1,3,3a,7) tetrazaindenes); benzenethiosulfonic acids; and benzenesulfinic acids; etc.

Greater detailed examples and methods of using them are described in, for example, U.S. Pat. Nos. 3,954,474, 3,982,947 and 4,021,248, and Japanese Patent Publication 28660/77.

Examples of harding agents include aldehyde compounds such as mucochloric acid, mucobromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran or glutaraldehyde; active vinyl compounds such as divinylsulfone, methylenebismaleimide, 5-acetyl-1,3-diacryloylhexahydro-s-triazine, 1,3,5-triacryloylhexahydro-s-triazine, 1,3,5-trivinylsulfonyl-hexahydro-s-triazine bis(vinylsulfonylmethyl)ether, 1,3-bis(vinylsulfonylmethyl)-propanol-2or bis(α-vinylsulfonylacetamide)ethane; active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethylamino)-s-triazine or N,N'-bis(2-chloroethylcarbamoyl)-piperazine; epoxy compounds such as bis(2,3-epoxypropyl)-methylpropylammonium p-toluenesulfonate, 1,4-bis(2',3'-epoxypropyloxy)butane, 1,3,5-triglycidyl isocyanurate or 1,3-diglycidyl-5-(γ-acetoxy-β-oxypropyl) isocyanurate; ethyleneimine compounds such as 2,4,6-triethyleneimino-s-triazine, 1,6-hexamethylene-N,N'-bisethyleneurea or bis-β-ethyleneiminoethyl thioether; methanesulfonic acid ester compounds such as 1,2-di(methanesulfonoxy)ethane, 1,4-di(methanesulfonoxy)butane or 1,5-di(methanesulfonoxy)pentane; carbodiimide compounds; isoxazole compounds; and inorganic compounds such as chromium alum.

The photographic emulsion layers or other constituent layers in the light-sensitive materials of the present invention may contain other surface active agents in addition to the surface active agent of the present invention, for various purposes, for example, as coating aids, for prevention of electrically charging, for improvement of lubricating properties, for aiding emulsification and dispersion, for prevention of adhesion, for improvement of photographic characteristics (for example, acceleration of development, high contrast, and sensitization), etc.

For example, it is possible to use nonionic surface active agents such as saponin (steroid type), alkylene oxide derivatives (for example, polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides and alkylphenol polyglycerides), aliphatic acid esters of polyhydric alcohols and alkyl esters of sugar, etc.; anionic surface active agents having acid groups such as a carboxyl group, a sulfo group, a phospho group, a sulfuric acid ester group, a phosphoric acid ester group, etc., such as alkylcarboxylates, alkylsulfonates, alkylbenzenesulfonates, alkylnaphthalenesulfonates, alkylsulfuric acid esters, alkylphosphoric acid esters, N-acyl-N-alkyltaurine, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric or phosphoric acid esters, alkylbetaines amine oxides, etc.; and cationic surface active agents such as alkylamine salts, aliphatic or aromatic quaternary ammonium salts, heterocyclic quaternary ammonium salts such as pyridinium or imidazolium salts, or phosphonium or sulfonium salts containing aliphatic or heterocyclic groups.

The Photographic emulsions of the present invention may be spectrally sensitized with methine dyes and others. Dyes that can be used include those belonging to cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes, and complex merocyanine dyes. In these dyes, any nuclei conventionally used as basic heterocyclic nuclei in cyanine dyes can be utilized. That is, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei in which the above described nuclei are condensed with an alicyclic hydrocarbon ring; and nuclei in which the above described nuclei are condensed with an aromatic hydrocarbon ring, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. The carbon atoms of these nuclei may also be substituented.

In merocyanine dyes and complex merocyanine dyes, it is possible to utilize 5- or 6-member heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus, a thiobarbituric acid nucleus, etc., as nuclie having a ketomethylene structure.

The photographic emulsions in the present invention may contain color image forming couplers, namely, compounds which form a dye by reacting with an oxidation product of an aromatic amine (generally a primary amine) developing agent (hereinafter referred to as coupler). As the couplers, non-diffusible couplers having a hydrophobic group called as ballast group in the molecule are desired. The couplers may be either of 4-equivalent type or 2-equivalent type with respect to silver ion. Further, colored couplers having an effect of color correction or couplers which release a development restrainer by development (the so-called DIR coupler) may be used. The couplers may be those which form a colorless product by a coupling reaction.

As yellow couplers, known ring-opened ketomethylene type couplers can be used. Benzoylacetanilide type and pivaloylacetanilide type compounds are advantageously used.

As magenta couplers, pyrazolone compounds, imidazolone compounds, cyanoacetyl compounds, etc., can be used. Pyrazolone compounds are particularly advantageously used.

As cyan couplers, phenol compounds, naphthol compounds, etc., can be used.

In the photographic light-sensitive materials of the present invention, the silver halide emulsion layers may be provided on one side of the base or both sides of the support.

The protective layer in the silver halide photographic light-sensitive materials of the present invention is a layer composed of a hydrophilic colloid. As hydrophilic colloids used for the protective layer, those described above can be used. The protective layer may be a single layer or a multilayer.

In the emulsion layers or the protective layers and, preferably, the protective layer in the silver halide photographic light-sensitive materials of the present invention, matting agents and/or lublicating agents may be added. As matting agents, organic compounds such as water dispersive vinyl polymers such as polymethyl methacrylate and inorganic compounds such as silver halide or strontium barium sulfate, etc., having a suitable particle size (e.g., those having a particle size of from 0.3 to 5 μm, or those having a particle size of 2 times or more, and preferably 4 times or more, the thickness of the protective layer) are suitably used. Lublicating agents are not only useful for preventing troubles caused by adhesion analogously to matting agents, but are also effective for improving friction characteristics having relation to camera adaptability in the case of taking a photograph or image projection. As examples, waxes such as liquid paraffin, higher aliphatic acid esters, etc., polyfluorinated hydrocarbons or derivatives thereof, silicones such as polyalkylpolysiloxane, polyarylpolysiloxane, polyalkylarylpolysiloxane, alkylene oxide adducts thereof, etc., are preferablly used.

The silver halide photographic light-sensitive materials of the present invention can be provided, if desired, with an antihalation layer, an inter layer, a filter layer, etc.

Examples of the silver halide photographic light-sensitive materials using the silver halide photographic emulsions of the present invention include X-ray light-sensitive materials, lithographic light-sensitive materials, black-and-white phogoraphic light-sensitive materials, color negative light-sensitive materials, color reversal light-sensitive materials, color printing paper, etc.

In the phogoraphic light-sensitive materials of the present invention, other various additives can be used as occasion demands. For example, dyes, development accelerators, brightening agents, color antifoggant, ultraviolet ray absorbing agents, etc., can be used. For example, those described in *Research Disclosure,* No. 176, pages 28–30 (RD-17643, 1978) can be used.

The photographic emulsions of the present invention are applied to flexible supports conventionally used in photographic light-sensitive materials, such as plastic films, paper, cloth, etc., or rigid supports such as glass, porcelains, metals, etc. by a dip coating method, a roll coating method, a curtain coating method, an extrusion coating method, etc.

Useful examples of the flexible supports include films of semisynthetic or synthetic polymers such as cellulose nitrate, cellulose acetate, cellulose acetate butyrate, polystyrene, polyvinyl chloride, polyethylene terephthalate, polycarbonate, etc., and papers coated or laminated with a baryta layer, α-olefin polymers (for example, polyethylene, polypropylene or ethylene/butene copolymer), etc.

In the following, the present invention is illustrated by reference to examples, but the present invention is not limited there to.

EXAMPLE 1

(1) Preparation of light-sensitive silver halide emulsion:

While maintaining the concentration of halogen before addition and a KBr concentration in a vessel in which gelatin was pleased at comparatively high values, a thick-tabular silver iodobromide emulsion (AgI: 2 mol %) having an average particle size of 1.3 μm was prepared from silver nitrate, potassium bromide, and potassium iodine by a conventional ammonia process, and it was precipitated and washed conventionally. Thereafter, it was chemically sensitized by a gold-sulfur sensitization process using chloroauric acid and sodium thiosulfate, and 4-hydroxy-6-methyl-1,3,3a,7-tetrazaindene was added as a stabilizer to obtain a light-sensitive silver iodobromide emulsion (A).

A thick-tabular silver iodobromide emulsion (AgI=4 mol %) having an average particle size of 1.3 μm was prepared in the same manner as the emulsion (A) (except that the amount of KI was increased), and it was chemically sensitized in the same manner as emulsion (A), and the stabilizer was added to obtain an emulsion (B).

(2) Production of coated sample:

To each of the emulsions (A) and (B), a coating aid (dodecylbenzenesulfonate) and a thickening agent (polypotassium p-vinylbenzenesulfonate) were added to prepare coating solutions. In this case, the ratio of silver/gelatin by weight was 0.95/1.

To the coating solutions of the above described emulsions (A) and (B), a polyoxyethylene type surface active agent and a mesoionic triazolium compound were added in amounts shown in Table 1, and they were applied to both sides of polyethylene terephthalate support simultaneously with applying a surface protective layer, and dried to produce photographic materials 1–14. For the surface protective layer, a 10 wt % aqueous solution of gelatin containing a thickening agent (sodium polystyrenesulfonate) a matting agent (polymethyl methacrylate fine-particles having an average particle size: 3.0 μm), a hardening agent (N,N'-ethylenebis(vinylsulfonylamide) and a coating aid(-sodium t-octyl-phenoxyethoxyethoxyethanesulfonate) was used. In this case, the amount of silver coated in the silver halide emulsion layers was 3.5 g/m$^2$ (one side) and the amount of gelatin coated in the surface protective layers was 1.3 g/m$^2$ (one side) and the thickness thereof was 1.0 μm.

(3) Sensitometry:

These samples were allowed to stand at 25° C. and 65% RH (relative humidity). After 7 days from application, each sample was exposed to blue light of 360–480 μm having a peak intensity at 414 μm using a tungsten lamp as light source and Filter SP-14 (manufactured by Fuji Photo Film Co., Ltd.). Thereafter, they were subjected to the following processes A or B, respectively.

Process A: After the sample was developed with a developing solution having the following formulation, at 31° C. or 37° C. for 25 seconds, and then it was subjected to fixing processing with a fixing solution having the following formula at 35° C. for 25 seconds, followed by washing with water and drying.

Process B: After the sample was developed with a developing solution having the following formulation at 25° C. for 2 minutes, it was subjected to fixing processing with the same fixing solution at 25° C. for 2 minutes, and then it was washed with water and dried.

| | |
|---|---|
| Developing solution A | |
| 1-Phenyl-3-pyrazolidone | 1.5 g |
| Hydroquinone | 30 g |
| 5-Nitroindazole | 0.25 g |
| KBr | 3.7 g |
| Anhydrous sodium sulfite | 20 g |
| Boric acid | 10 g |
| 25% aqueous solution of glutaraldehyde | 20 ml |
| Water to make | 1,000 ml |
| (pH was adjusted to 10.20 with NaOH) | |
| Developing solution B | |
| 1-Phenyl-3-pyrazolidone | 0.5 g |
| Hydroquinone | 20.0 g |
| Sodium ethylenediaminetetraacetate | 2.0 g |
| Potassium sulfite | 60.0 g |
| Boric acid | 4.0 g |
| Potassium carbonate | 20.0 g |
| Sodium bromide | 5.0 g |
| Diethylene glycol | 30.0 g |
| Water to make | 1,000 ml |
| (pH was adjusted to 10.0 with NaOH) | |
| Fixing solution | |
| Ammonium thiosulfate | 200.0 g |

-continued

| | |
|---|---|
| Sodium sulfite (anhydrous) | 20.0 g |
| Boric acid | 8.0 g |
| di sodium ethylenediaminetetraacetate | 0.1 g |
| Aluminium sulfate | 15.0 g |
| Sulfuric acid | 2.0 g |
| Glacial acetic acid | 22.0 g |
| Water to make | 1,000 ml |
| (pH was adjusted to 4.2 with NaOH) | |

Sensitometry of the processed photographic materials was carried out. The results are shown in Table 1.

In Table 1, the value of sensitivity is that obtained in the case of developing with the developing solution B at 25° C., which is obtained by determining as an inverse number the exposure amount necessary to obtain a transmission light blackening density of fog+1.0, shown as a relative value based on the sensitivity of Sample No. 5 being taken as 100. Granularity of these samples was measured and evaluated as one of 5 grades. 5 was very good, 4 was good, 3 indicated a problem in practical use, 2 was inferior, and 1 was very inferior.

Processing temperature reliance is shown as a ratio of gradations $\gamma$ in the case of carrying out development at 31° C. and 37° C. with the developing solution A ($\gamma$ 37° C./$\gamma$ 31° C.). In this case, as $\gamma$, a gradient of the characteristic curve between "fog+0.2" and "fog+1.0" was used.

Pressure fog caused by rollers was measured by developing at 35° C. with a developing solution in which the amount of glutaraldehyde in the developing solution A was reduced to 50% of the prescribed amount by means of an automatic developing apparatus having a pair of rollers in which rollers having a rough surface (surface roughness (height of protrusion on the surface): 0.5 mm) were used, and roller mark formed by pressure of rollers was evaluated one of 5 grades. The roller mark-preventing property was evaluated as follows; 5 indicated that roller mark did not occur, 4 indicated that roller mark slightly occurred to an extent which was still allowable in practical use, 3 indicated that roller mark occurred to an extent which was not allowable in practical use, 2 indicated occurrence to a large extent, and 1 indicated extreme occurrence.

TABLE 1

| Sample No. | Kind of emulsion | Polyoxyethylene type surface active agent mg/m$^2$ (one-side) | Compound of formula (I) mol/mol Ag | Sensitivity | Granularity | Processing temperature reliance (ratio of $\gamma$) | Roller mark-preventing property |
|---|---|---|---|---|---|---|---|
| 1-1 | Emulsion (A) | none | none | 98 | 5 | 1.45 | 3 |
| 1-2 | " | II-(28) 5 | I-8 $1.56 \times 10^{-4}$ | 109 | 4-5 | 1.08 | 2 |
| 1-3 | " | II-(28) 5 | I-8 $3.12 \times 10^{-4}$ | 118 | " | 0.95 | 2 |
| 1-4 | " | II-(28) 10 | I-8 $3.12 \times 10^{-4}$ | 105 | 4 | 1.00 | 1 |
| 1-5 | Emulsion (B) | none | none | 100 (standard) | 5 | 2.01 | 5 |
| 1-6 | " | II-(28) 1 | none | 105 | " | 1.95 | " |
| 1-7 | " | II-(28) 2 | none | 123 | 4 | 1.85 | 4-5 |
| 1-8 | " | II-(28) 5 | none | 145 | 3 | 1.73 | 4 |
| 1-9 | " | none | I-8 $1.56 \times 10^{-4}$ | 85 | 5 | 1.75 | 5 |
| 1-10 | " | none | I-8 $3.12 \times 10^{-4}$ | 71 | " | 1.55 | " |
| 1-11 | " | none | I-8 $6.24 \times 10^{-4}$ | 54 | " | 1.25 | 4-5 |
| 1-12* | " | II-(28) 5 | I-8 $1.56 \times 10^{-4}$ | 132 | 4 | 1.34 | 4 |
| 1-13* | " | II-(28) 5 | I-8 $3.12 \times 10^{-4}$ | 106 | 4-5 | 1.25 | 4 |
| 1-14* | " | II-(28) 10 | I-8 $3.12 \times 10^{-4}$ | 115 | 4 | 1.21 | 4 |

*Present invention

As shown in Table 1, in the case of the emulsion (A) (iodine: 2 mol %), the processing temperature reliance became fairly good by using the compound represented by the general formula (I) of the present invention and the polyoxyethylene type surface active agent together, but roller mark property indicated a level which could not be used. (Sample Nos. 1-2 to 1-4)

On the contrary, in case of the emulsion (B) of the present invention (iodine: 4 mol %), the processing temperature reliance was remarkably improved by using the above described compounds, and deterioration of granularity was prevented even if the developing solution contained no glutaraldehyde. Further, the roller mark property reached an allowable level. (Sample Nos. 1-12 to 1-14)

EXAMPLE 2

5 parts of the same thick-tabular silver iodobromide emulsion (B) having AgI=4 mol %, as that used in Example 1, were mixed with 1 part of a silver iodobromochloride emulsion (C) having a particle size of 0.3 $\mu$m which was prepared by the process described in U.S. Pat. No. 2,592,250 so as to have a sensitivity as low as about 1/100 of the above described emulsion, in which fog was previously formed in the inside of grains with light. To the resulting emulsion mixture, the same coating aid and thickening agent as those in Example 1 were added to prepare a coating solution. In this case, the ratio of silver/gelatin by weight was 0.95/1. To this emulsion coating solution, a mesoionic triazolium compound and a polyoxyethylene type surface active agent were added so as to have a formulation shown in Table 2, and it was applied together with a surface protective layer in the same manner as in Example 1, except that the amount of silver coated was 2.7 g/m$^2$ (one side), and dried to produce samples 2-1 to 2-11. Sensitometry, test for roller mark-preventing property and measurement of granularity were carried out in the same manner as in Example 1. The results obtained are shown in Table 2.

TABLE 2

| Sample No. | Kind of emulsion | Polyoxyethylene type surface active agent mg/m$^2$ (one side) | Compound of formula (I) mol/mol Ag | Sensitivity | Granularity | Processing temperature reliance (ratio of $\gamma$) | Roller mark-preventing property |
|---|---|---|---|---|---|---|---|
| 2-1 | Emulsion (B) + | none | none | 100 | 5 | 2.10 | 5 |

TABLE 2-continued

| Sample No. | Kind of emulsion | Polyoxyethylene type surface active agent mg/m$^2$ (one side) | Compound of formula (I) mol/mol Ag | Sensitivity | Granularity | Processing temperature reliance (ratio of γ) | Roller mark-preventing property |
|---|---|---|---|---|---|---|---|
| | Emulsion (C) | | | (standard) | | | |
| 2-2 | Emulsion (B) + Emulsion (C) | II-(10) 17.5 | none | 112 | 4 | 2.01 | 4–5 |
| 2-3 | Emulsion (B) + Emulsion (C) | II-(10) 35 | none | 150 | 3 | 1.85 | 4 |
| 2-4 | Emulsion (B) + Emulsion (C) | II-(10) 70 | none | 170 | 2 | 1.70 | " |
| 2-5 | Emulsion (B) + Emulsion (C) | none | I-1 $1.4 \times 10^{-3}$ | 83 | 5 | 1.90 | 5 |
| 2-6 | Emulsion (B) + Emulsion (C) | none | I-1 $1.8 \times 10^{-3}$ | 78 | " | 1.80 | 4–5 |
| 2-7 | Emulsion (B) + Emulsion (C) | none | I-1 $2.8 \times 10^{-3}$ | 65 | " | 1.71 | " |
| 2-8* | Emulsion (B) + Emulsion (C) | II-(10) 35 | I-1 $1.4 \times 10^{-3}$ | 118 | 4 | 1.56 | 4 |
| 2-9* | Emulsion (B) + Emulsion (C) | II-(10) 35 | I-1 $1.8 \times 10^{-3}$ | 113 | 4–5 | 1.48 | " |
| 2-10* | Emulsion (B) + Emulsion (C) | II-(10) 70 | I-1 $1.4 \times 10^{-3}$ | 136 | 4 | 1.37 | " |
| 2-11* | Emulsion (B) + Emulsion (C) | II-(10) 70 | I-1 $1.8 \times 10^{-3}$ | 125 | 4 | 1.30 | " |

*Present invention

As shown in Table 2, in the mixture system of the high-iodide high-sensitivity emulsion (B) and the internal fogged low-sensitivity emulsion (C), processing temperaturee reliance is remarkably improved by using the polyoxyethylene type surface active agent and the compound represented by formula (I) together, and deterioration of granularity can be tolerably prevented even if developing solution B containing no glutaraldehyde is used. Further, roller mark-preventing property can be kept at an allowable level, and desensitization is not caused. (Sample Nos. 2-8 to 2-11)

EXAMPLE 3

A sample was produced by the same manner as in Example 2, except that a polyoxyethylene type surface active agent II-(52) was used instead of the polyoxyethylene type surface active agent II-(10) in Sample No. 2-8, and sensitometry was carried out.

The resulted sample gave excellent results in processing temperature reliance, granularity and roller mark-preventing property.

While the invention has been described in detail and with reference to specific embodiments thereof, it will be apparent to one skilled in the art that various changes and modifications can be made therein without departing from the spirit and scope thereof.

What is claimed is:

1. A wet developable silver halide photographic light-sensitive material comprising at least one light-sensitive silver halide emulsion layer on a support, wherein the emulsion in said light-sensitive silver halide emulsion layer comprises a silver iodobromide emulsion containing 3 mol % or more of iodide, and at least one of said light-sensitive emulsion layer or another hydrophilic colloid layer contains a polyoxyethylene surface active agent and at least one of said light-sensitive emulsion layer or another hydrophilic colloid layer contains a meso-ionic triazolium compound represented by formula (I)

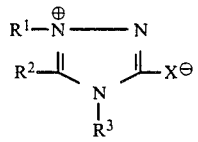

(I)

wherein X represents a sulfur ion or —N—$R^4$, and $R^1$, $R^2$, $R^3$, or $R^4$ each represents a hydrogen atom or a substituted or nonsubstituted alkyl group, aryl group, or heterocyclic group, or $R^1$ and $R^2$, $R^2$ and $R^3$ or $R^3$ and $R^4$ can together form a heterocyclic ring.

2. A silver halide photographic light-sensitive material as in claim 1, wherein the silver iodobromide emulsion has an iodide content of from 3 to 10 mol %.

3. A silver halide photographic light-sensitive material as in claim 1, wherein said polyoxyethylene surface active agent comprises 2 or more oxyethylene groups.

4. A silver halide photographic light-sensitive material as in claim 1, wherein said polyoxyethylene surface active agent comprises from 5 to 50 oxyethylene groups.

5. A silver halide photographic light-sensitive material as in claim 2, wherein said polyoxyethylene surface active agent comprises 2 or more oxyethylene groups.

6. A silver halide photographic light-sensitive material as in claim 1, wherein said polyoxyethylene surface active agent is selected from the group consisting of surface active agents represented by formulae (II-1), (II-2), and (II-3)

$$R_{11}-A\text{-}(CH_2CH_2O)_{n_1}H \quad \text{(II-1)}$$

(II-2)

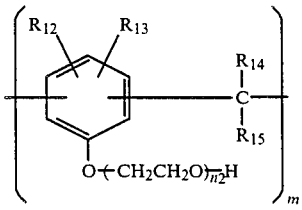

-continued (II-3)

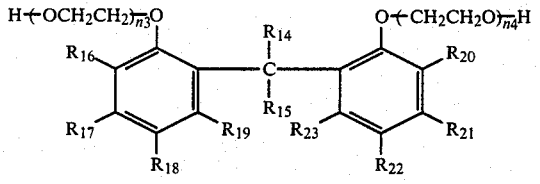

wherein $R_{11}$ represents a substituted or nonsubstituted alkyl, alkenyl or aryl group having from 1 to 30 carbon atoms; A represents —O—, —S—, —COO—, $$-\underset{|}{N}-R_{24},\ -CO-\underset{|}{N}-R_{24},\ \text{or}\ -SO_2\underset{|}{N}-R_{24},$$

wherein $R_{24}$ represents a hydrogen atom or a substituted or nonsubstituted alkyl group; $R_{12}$, $R_{13}$, $R_{17}$, $R_{19}$, $R_{21}$, and $R_{23}$ each reepresents a hydrogen atom, a substituted or nonsubstituted alkyl group, an aryl group, an alkoxy group, a halogen atom, an acyl group, an amide group, a sulfonamide group, a carbamoyl group, or a sulfamoyl group; $R_{16}$, $R_{18}$, $R_{20}$, and $R_{22}$ each represents a substituted or nonsubstituted alkyl group, an aryl group, an alkoxy group, a halogen atom, an acyl group, an amide group, a sulfonamide group, a carbamoyl group, or a sulfamoyl group; $R_{14}$ and $R_{15}$ each represents a hydrogen atom, or a substituted or nonsubstituted alkyl, aryl or heteroaromatic group; or $R_{14}$ and $R_{15}$, $R_{16}$ and $R_{17}$, $R_{18}$ and $R_{19}$, $R_{20}$ and $R_{21}$, and $R_{22}$ and $R_{23}$ can together form a substituted or nonsubstituted ring; $n_1$, $n_2$, $n_3$, and $n_4$ refer to the average degree of polymerization of the ethylene oxide, each is a number of 5 to 50; and m refers to the average degree of polymerization of the main chain of formula (II-2) and is a number of from 5 to 50.

7. A silver halide photographic light-sensitive material as in claim 2, wherein said polyoxyethylene surface active agent is selected from the group consisting of surface active agents represented by formulae (II-1), (II-2), and (II-3)

$$R_{11}-A\text{-}(CH_2CH_2O)_{n1}H \qquad \text{(II-1)}$$

(II-2)

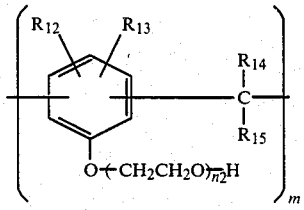

(II-3)

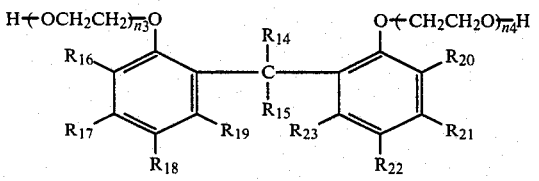

wherein $R_{11}$ represents a substituted or nonsubstituted alkyl, alkenyl or aryl group having from 1 to 30 carbon atoms; A represents —O—, —S—, —COO—, $$-\underset{|}{N}-R_{24},\ -CO-\underset{|}{N}-R_{24},\ \text{or}\ -SO_2\underset{|}{N}-R_{24},$$

wherein $R_{24}$ represents a hydrogen atom or a substituted or nonsubstituted alkyll group; $R_{12}$, $R_{13}$, $R_{17}$, $R_{19}$, $R_{21}$, and $R_{23}$ each represents a hydrogen atom, a substituted or nonsubstituted alkyl group, an aryl group, an alkoxy group, a halogen atom, an acyl group, an amide group, a sulfonamide group, a carbamoyl group, or a sulfamoyl group; $R_{16}$, $R_{18}$, $R_{20}$, and $R_{22}$ each represents a substituted or nonsubstituted alkyl group, an aryl group, an alkoxy group, a halogen atom, an acyl group, an amide group, a sulfonamide group, a carbamoyl group, or a sulfamoyl group; $R_{14}$ and $R_{15}$ each represents a hydrogen atom, or a substituted or nonsubstituted alkyl, aryl or heteroaromatic group; or $R_{14}$ and $R_{15}$, $R_{16}$ and $R_{17}$, $R_{18}$ and $R_{19}$, $R_{20}$ and $R_{21}$, and $R_{22}$ and $R_{23}$ can together form a substituted or nonsubstituted ring; $n_1$, $n_2$, $n_3$, and $n_4$ refer to the average degree of of polymerization of the ethylene oxide, each is a number of 5 to 50; and m refers to the average degree of polymerization of the main chain of formula (II-2) and is a number of from 5 to 50.

8. A silver halide photographic light-sensitive material as in claim 6, wherein $R_{11}$ represents an alkyl, alkenyl or alkylaryl group having from 4 to 24 carbon atoms; $R_{12}$, $R_{13}$, $R_{16}$, $R_{17}$, $R_{18}$, $R_{20}$, $R_{21}$, $R_{22}$ and $R_{23}$ each represents a substituted or nonsubstituted alkyl group having from 1 to 20 carbon atoms, a substituted or nonsubstituted aryl group, a substituted or nonsubstituted alkoxy group represented by —$OR_{25}$, wherein $R_{25}$ represents a substituted or nonsubstituted alkyl group having from 1 to 20 carbon atoms or an aryl group, a halogen atom, an acyl group represented by —$COR_{25}$ wherein $R_{25}$ has the above meaning, an amide group represented by —$NR_{26}COR_{25}$ wherein $R_{25}$ has the above meaning and wherein $R_{26}$ represents a hydrogen atom or an alkyl group having from 1 to 20 carbon atoms, a sulfonamide group represented by —$NR_{26}SO_2R_{25}$, a carbamoyl group represented by $$-CON\begin{matrix}R_{26}\\R_{26}\end{matrix}$$

or a sulfamoyl group represented by $$-SO_2N\begin{matrix}R_{26}\\R_{26}\end{matrix},$$

where $R_{25}$ and $R_{26}$ have the above meanings, and $R_{12}$, $R_{13}$, $R_{17}$, $R_{19}$, and $R_{23}$ can each be a hydrogen atom; $R_{14}$ and $R_{15}$ each represents a hydrogen atom, a substituted or nonsubstituted alkyl group, or a substituted or nonsubstituted aryl group; or $R_{14}$ and $R_{15}$, $R_{16}$ and $R_{17}$, $R_{18}$ and $R_{19}$, $R_{20}$ and $R_{21}$, and $R_{22}$ and $R_{23}$ together can form a substituted or nonsubstitutd ring; and $n_1$, $n_2$, $n_3$, and $n_4$ each is a number of from 5 to 30.

9. A silver halide photographic light-sensitive material as in claim 7, wherein $R_{11}$ represents an alkyl, alkenyl or alkylaryl group having from 4 to 24 carbon atoms; $R_{12}$, $R_{13}$, $R_{16}$, $R_{17}$, $R_{18}$, $R_{20}$, $R_{21}$, $R_{22}$ and $R_{23}$ each represents a substituted or nonsubstituted alkyl group having from 1 to 20 carbon atoms, a substituted or nonsubstituted aryl group, a substituted or nonsubstituted alkoxy group represented by —$OR_{25}$, wherein $R_{25}$ represents a substituted or nonsubstituted alkyl group having from 1 to 20 carbon atoms or an aryl group, a halogen atom, an acyl group representd by —$COR_{25}$ wherein $R_{25}$ has the above meaning, an amide group represented by —$NR_{26}COR_{25}$ wherein $R_{25}$ has the above meaning and wherein $R_{26}$ represents a hydrogen atom or an alkyl group having from 1 to 20 carbon atoms, a sulfonamide group represented by —$NR_{26}SO_2R_{25}$, a carbamoyl group represented by

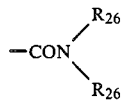

or a sulfamoyl group represented by

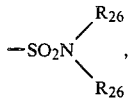

where $R_{25}$ and $R_{26}$ have the above meanings, and $R_{12}$, $R_{13}$, $R_{17}$, $R_{19}$, and $R_{23}$ can each be a hydrogen atom; $R_{14}$ and $R_{15}$ each represents a hydrogen atom, a substituted or nonsubstitited alkyl group, or a substituted or nonsubstituted aryl group; or $R_{14}$ and $R_{15}$, $R_{16}$ and $R_{17}$, $R_{18}$ and $R_{19}$, $R_{20}$ and $R_{21}$, and $R_{22}$ and $R_{23}$ together can form a substituted or nonsubstituted ring; and $n_1$, $n_2$, $n_3$, and $n_4$ each is a number of from 5 to 30.

10. A silver halide photographic light-sensitive material as in claim 8, wherein $R_{11}$ is selected from a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group, or an octylnaphthyl group; $R_{16}$, $R_{18}$, $R_{20}$, and $R_{22}$ each represents an alkyl group or a halogen atom, and $R_{17}$, $R_{19}$, $R_{21}$, and $R_{23}$ each represents a hydrogen atom; and $R_{14}$ and $R_{15}$ each represents a hydrogen atom, an alkyl group having from 1 to 8 carbon atoms, a phenyl group, or a furyl group.

11. A silver halide photographic light-sensitive material as in claim 6, wherein the polyoxyethylene surface active agent is selected from those represented by formulae (II-2) and (II-3).

12. A silver halide photographic light-sensitive material as in claim 8, wherein the polyoxyethylene surface active agent is selected from those represented by formulae (II-2) and (II-3).

13. A silver halide photographic light-sensitive material as in claim 10, wherein the polyoxyethylene surface active agent is selected from those represented by formulae (II-2) and (II-3).

14. A silver halide photographic light-sensitive material as in claim 6, wherein said polyoxyethylene surface active agent is a compound represented by formula (II-3).

15. A silver halide photographic light-sensitive material as in claim 1, wherein the meso-ionic triazolium compound represented by formula (I) is present in a range of from $5\times10^{-6}$ to $5\times10^{-2}$ to mols per mol of silver and the polyoxyethylene type surface active agent is present in a range of from 0.05 to 500 mg per $m^2$ of the photographic light-sensitive material.

16. A silver halide photographic light-sensitive material as in claim 1, wherein said light-sensitive silver halide emulsion layer further comprises a silver halide emulsion in which the inside is fogged.

17. A silver halide photographic light-sensitive material as in claim 16, wherein the sensitivity of said silver halide emulsion in which the inside is fogged is 1/10 or less the sensitivity of said silver iodobromide emulsion.

18. A silver halide photographic light-sensitive material as in claim 17, wherein said silver halide emulsion in which the inside is fogged has an average particle size of from 1.0 to 0.05 μm.

19. A silver halide photographic light-sensitive material as in claim 18, wherein said average particle size is from 0.6 to 0.1 μm.

20. A silver halide photographic light-sensitive material as claim 16, wherein the weight ratio of the silver iodobromide to the silver halide in which the inside is fogged is from 1/100 to 100/1.

21. A silver halide photographic light-sensitive material as claim 16, wherein the total amount of silver halides coated is from 0.5 to 10 g/$cm^2$ calculated as silver.

22. A process comprising developing an image-wise exposed silver halide photographic light-sensitive material with a developing solution to form an image, said silver halide photographic light-sensitive material comprising a support having thereon at least one light-sensitive silver halide emulsion layer, wherein at least one emulsion in said light-sensitive silver halide emulsion layer comprises a silver iodobromide emulsion containing 3 mol% or more of iodide, and at least one of said at least one light-sensitive emulsion layer or another hydrophilic colloid layer contains a polyoxyethylene surface active agent and at least one of said at least one light-sensitive emulsion layer or another hydrophilic colloid layer contains a meso-ionic traiazolium compound represented by formula (I)

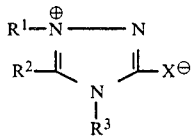

(I)

wherein X represents a sulfur ion or —N—$R^4$, and $R^1$, $R^2$, $R^3$ or $R^4$ each represents a hydrogen atom or a substituted or unsubstituted alkyl group, an aryl group or a heterocyclic group, or $R^1$ and $R^2$, $R^2$ and $R^3$ or $R^3$ and $R^4$ can together form a heterocyclic ring.

23. A process as in claim 22, wherein the silver iodobromide emulsion has an iodide content of from 3 to 10 mol%.

24. A process as in claim 22, wherein said polyoxyethylene surface active agent comprises 2 or more oxyethylene groups.

25. A process as in claim 22, wherein said polyoxyethylene surface active agent is selected from the group consisting of surface active agents represented by formulae (II-1), (II-2) and (II-3)

$$R_{11}-A\text{-}(CH_2CH_2O)_{\overline{n}}]H \qquad \text{(II-1)}$$

-continued (II-2)

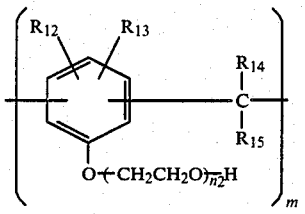

(II-3)

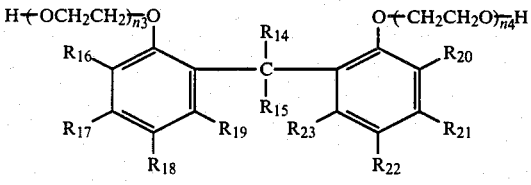

wherein $R_{11}$ represents a substituted or unsubstituted alkyl, alkenyl or aryl group having from 1 to 30 carbon atoms; A represents —O—, —S—, —COO—, $$-\underset{|}{N}-R_{24},\ -CO-\underset{|}{N}-R_{24},\ \text{or}\ -SO_2\underset{|}{N}-R_{24},$$

wherein $R_{24}$ represents a hydrogen atom or a substituted or unsubstituted alkyl group; $R_{12}$, $R_{13}$, $R_{17}$, $R_{19}$, $R_{21}$ and $R_{23}$ each represents a hydrogen atom, a substituted or unsubstituted alkyl group, an aryl group, an alkoxy group, a halogen atom, an acyl group, an amide group, a sulfonamide group, a carbamoyl group, or a sulfamoyl group; $R_{16}$, $R_{18}$, $R_{20}$ and $R_{22}$ each represents a substituted or unsubstituted alkyl group, an aryl group, an alkoxy group, a halogen atom, an acyl group, an amide group, a sulfonamide group, a carbamoyl group or a sulfamoyl group; $R_{14}$ and $R_{15}$, $R_{16}$ and $R_{17}$, $R_{18}$ and $R_{19}$, $R_{20}$ and $R_{21}$, and $R_{22}$ and $R_{23}$ can together form a substituted or unsubstituted ring; $n_1$, $n_2$, $n_3$ and $n_4$ refer to the average degree of polymerization of the ethylene oxide, and each is a number of 5 to 50; and m refers to the average degree of polymerization of the main chain of formula (II-2) and is a number of from 5 to 50.

26. A process as in claim 25, wherein $R_{11}$ represents an alkyl, alkenyl or alkylaryl group having from 4 to 24 carbon atoms; $R_{12}$, $R_{13}$, $R_{16}$, $R_{17}$, $R_{18}$, $R_{20}$, $R_{21}$, $R_{22}$ and $R_{23}$ each represents a substituted or nonsubstituted alkyl group having from 1 to 20 carbon atoms, a substituted or nonsubstituted aryl group, a substituted or nonsubstituted alkoxy group represented by —$OR_{25}$, wherein $R_{25}$ represents a substituted or nonsubstituted alkyl group having from 1 to 20 carbon atoms or an aryl group, a halogen atom, an acyl group represented by —$COR_{25}$ wherein $R_{25}$ has the above meaning, an amide group represented by —$NR_{26}COR_{25}$ wherein $R_{25}$ has the above meaning and wherein $R_{26}$ represents a hydrogen atom or an alkyl group having from 1 to 20 carbon atoms, a sulfonamide group represented by —$NR_{26}SO_2R_{25}$, a carbamoyl group represented by

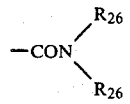

or a sulfamoyl group represented by

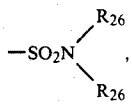

where $R_{25}$ and $R_{26}$ have the above meanings, and $R_{12}$, $R_{13}$, $R_{17}$, $R_{19}$, and $R_{23}$ can each be a hydrogen atom; $R_{14}$ and $R_{15}$ each represents a hydrogen atom, a substituted or nonsubstituted alkyl group, or a substituted or nonsubstituted aryl group; or $R_{14}$ and $R_{15}$, $R_{16}$ and $R_{17}$, $R_{18}$ and $R_{19}$, $R_{20}$ and $R_{21}$, and $R_{22}$ and $R_{23}$ together can form a substituted or nonsubstituted ring; and $n_1$, $n_2$, $n_3$, and $n_4$ each is a number of from 5 to 30.

27. A process as in claim 22, wherein the meso-ionic triazolium compound represented by formula (I) is present in a range of from $5\times10^{-6}$ to $5\times10^{-2}$ to mols per mol of silver and the polyoxyethylene surface active agent is present in a range of from 0.05 to 500 mg per $m^2$ of the photographic light-sensitive material.

28. A process as in claim 22, wherein said light-sensitive silver halide emulsion layer further comprises a silver halide emulsion in which the inside is fogged.

29. A silver halide photographic light-sensitive material as in claim 1, wherein the silver iodobromide emulsion has an iodide content of from 4 to 10 mol%.

30. A process as in claim 22, wherein the silver iodobromide emulsion has an iodide content of from 4 to 10 mol%.

* * * * *